US011668225B1

(12) United States Patent
Woods et al.

(10) Patent No.: US 11,668,225 B1
(45) **Date of Patent: *Jun. 6, 2023**

(54) TWO-STAGE WATER-LIFT MUFFLER FOR MARINE GENERATOR

(71) Applicants: Woodrow Woods, Riviera Beach, FL (US); Darrin Woods, Riviera Beach, FL (US)

(72) Inventors: Woodrow Woods, Riviera Beach, FL (US); Darrin Woods, Riviera Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/888,902

(22) Filed: Aug. 16, 2022

Related U.S. Application Data

(63) Continuation of application No. 16/381,697, filed on Apr. 11, 2019, now Pat. No. 11,415,037.

(60) Provisional application No. 62/655,869, filed on Apr. 11, 2018.

(51) Int. Cl.

| | |
|---|---|
| ***F01N 13/00*** | (2010.01) |
| ***G10K 11/162*** | (2006.01) |
| ***F01N 1/08*** | (2006.01) |
| ***B63H 21/32*** | (2006.01) |

(52) U.S. Cl.
CPC ..... *F01N 13/004* (2013.01); *B63H 21/32* (2013.01); *F01N 1/08* (2013.01); *G10K 11/162* (2013.01)

(58) Field of Classification Search
CPC ..... F01N 13/004; F01N 1/08; B63H 21/32; G10K 11/162
See application file for complete search history.

(56) References Cited

U.S. PATENT DOCUMENTS

| | | | | |
|---|---|---|---|---|
| 5,196,655 | A * | 3/1993 | Woods | F01N 13/16 440/890 |
| 5,228,876 | A | 7/1993 | Woods | |
| 5,262,600 | A | 11/1993 | Woods | |
| 5,444,196 | A | 8/1995 | Woods | |
| 5,504,280 | A | 4/1996 | Woods | |
| 5,616,893 | A | 4/1997 | Woods | |
| 5,625,173 | A | 4/1997 | Woods | |
| 5,718,462 | A | 2/1998 | Woods | |
| 5,746,630 | A * | 5/1998 | Ford | B63H 21/32 440/89 R |
| 6,564,901 | B2 | 5/2003 | Woods | |
| 7,581,620 | B2 | 9/2009 | Woods et al. | |
| 7,905,322 | B2 | 3/2011 | Woods et al. | |

(Continued)

*Primary Examiner* — Forrest M Phillips
(74) *Attorney, Agent, or Firm* — Mark D. Bowen, Esq.; Malin Haley DiMaggio & Bowen, P.A.

(57) ABSTRACT

A two-stage water-lift and water separation muffler for use with marine electrical generators installed onboard marine vessels. A first stage water-lift muffler has internal tunable sound suppression structure to provide a first stage of exhaust silencing, and a second stage water separator having internal tunable sound suppression structure to provide a second stage of exhaust silencing while separating entrained cooling water from exhaust gases. The combined first stage water-lift muffler and second stage water separator include internal baffling and silencing structure which is easily adaptable to different generator configurations thereby allowing for structural adjustments to the muffler to optimize sound suppression and minimize backpressure for particular generator and/or exhaust conditions.

8 Claims, 5 Drawing Sheets

(56) References Cited

U.S. PATENT DOCUMENTS

| | | | | |
|---|---|---|---|---|
| 7,942,238 | B2 | 5/2011 | Woods | |
| 8,246,403 | B2 | 8/2012 | Woods | |
| 8,992,275 | B1 | 3/2015 | Woods | |
| 9,273,588 | B1 | 3/2016 | Woods et al. | |
| 9,562,450 | B1 | 2/2017 | Woods et al. | |
| 9,873,497 | B1 | 1/2018 | Woods et al. | |
| 10,054,029 | B1 | 8/2018 | Woods et al. | |
| 10,724,410 | B1 * | 7/2020 | Waisanen ..... | B63H 20/24 |
| 11,415,037 | B1 * | 8/2022 | Woods ..... | B63H 21/32 |

* cited by examiner

TWO-STAGE WATER-LIFT MUFFLER FOR MARINE GENERATOR

CROSS REFERENCE TO RELATED APPLICATIONS

This application is a continuation of U.S. patent application Ser. No. 16/381,697, filed Apr. 11, 2019, now U.S. Pat. No. 11,415,037, which claims the benefit of provisional U.S. Patent Application Ser. No. 62/655,869, filed on Apr. 11, 2018.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all rights whatsoever.

BACKGROUND OF THE INVENTION

1. Field of the Invention

The present invention relates generally to marine exhaust systems for use with internal combustion marine engines and generators, and more particularly to an improved two-stage water-lift muffler particularly suited for use with a marine generator onboard a marine vessel.

2. Description of Related Art

The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 C.F.R. § 1.56(a) exists.

Marine vessels are typically configured with a propulsion system powered by an internal combustion engine mounted within the vessel hull. Exhaust generated by the engine is commonly combined with cooling water and routed through exhaust conduit to the stern of the vessel via one or more exhaust ducts where the exhaust is discharged through one or more exhaust ports formed in the transom. One or more mufflers are installed within the exhaust duct(s) to silence noise associated with the engine and exhaust gases.

A variety of structures are known in the background art for use in silencing marine exhaust noise. The present inventor has invented a number of novel marine exhaust components that have greatly improved the silencing and efficiency of marine exhaust systems.

In U.S. Pat. No. 5,262,600, the first named inventor herein disclosed an in-line insertion muffler for marine engines employing a first housing encompassing a second housing which is partitioned by an angularly disposed inner planar baffle that has proven extremely effective in reducing engine noise. In U.S. Pat. No. 5,444,196, the first named inventor herein disclosed an improved version of the in-line muffler having a corrugated sleeve disposed between in the first and second housings. In U.S. Pat. No. 5,625,173, the first named inventor herein disclosed a single baffle linear muffler with an angularly disposed baffle that may be planer, convex, or concave. In U.S. Pat. No. 7,581,620, the first named inventor herein disclosed a marine muffler comprising an elongate cylindrical housing having an inlet and an outlet, and an internal volume partitioned by an angularly disposed internal baffle into a lower chamber in communication with the inlet and an upper chamber in communication with the outlet. A centrally disposed duct passes through the baffle to allow exhaust gas and exhaust cooling water to flow from the lower inlet chamber to upper outlet chamber. The various linear mufflers made in accordance with the above-referenced patents have achieved tremendous success and widespread acceptance within the marine industry. Such muffler systems have been successfully installed on a wide variety of marine vessels having engines in excess of 1,000 horsepower.

An additional need exists in the art, however, for muffler systems specifically adapted for use with onboard marine electrical generators. Many generators are installed at or below the boat's maximum heeled waterline (for powerboats this is the waterline when heeling at an angle of 7°). Similar to marine propulsion engines, marine generators use seawater for cooling the generator motor. Nearly every generator manufacturer provides instructions for installing the exhaust and seawater systems. Those guidelines ensure that seawater will not migrate into the generator's exhaust manifold and cylinders. The seawater used for cooling the generator motor is also injected into the exhaust stream to cool the exhaust gases. A muffler system is typically installed downstream of the generator exhaust outlet to silence exhaust noise. Since the generators are often installed at or below the waterline, the exhaust gas and entrained cooling water must be routed upward, above the waterline prior to being discharged from the vessel. As used herein the term "wet exhaust" shall refer to the combination of exhaust gas generated by an internal combustion engine combined with entrained cooling water and/or water vapor, originating from the injection of cooling water into the exhaust stream.

Past marine generator muffler systems have comprised basic exhaust and cooling water handling components that have succeeded in routing the exhaust gas and cooling water, but have failed to provide sufficient exhaust silencing. Some of the previous systems have been designed as two-stage systems. Such systems have a water-lift muffler disposed below the waterline and an exhaust/water separator disposed above the waterline. Generator exhaust gas and entrained cooling water are first injected into the water-lift muffler and then lifted via exhaust pressure into the separator via a generally vertically disposed connecting pipe. Exhaust gas exits an exhaust gas outlet, and water exits a water drain outlet. An example of such a system is available from Centek Industries, Inc., and combines a side-in top-out wet exhaust muffler sold under the trademark VERNALIFT®, with an exhaust/water separator sold under the trademark GEN-SEP®. VERNALIFT® and GEN-SEP® are registered trademarks of Centek Industries, Inc. (Thomasville, Ga.). The prior art systems, including the Centek two-stage system, suffer from a number of shortcomings. One significant shortcoming relates to poor exhaust gas silencing which is believed to result from insufficient internal muffling structure capable of silencing exhaust sound. Accordingly, there exit a need for an improved water-lift muffler system specifically designed for use with marine generators.

BRIEF SUMMARY OF THE INVENTION

The present invention overcomes limitations present in the art by providing an improved two-stage water-lift and water separation muffler for use with marine electrical generators installed onboard marine vessels. The two-stage water-lift muffler system of the present invention includes a first stage water-lift muffler having internal tunable sound suppression structure to provide a first stage of exhaust silencing, and a second stage water separator having internal tunable sound suppression structure to provide a second stage of exhaust silencing while separating entrained cooling water from exhaust gases. The combined first stage water-lift muffler and second stage water separator include internal baffling and silencing structure which is easily adaptable to different generator configurations thereby allowing for structural adjustments to the muffler to optimize sound suppression and minimize backpressure for particular generator and/or exhaust conditions.

Accordingly, it is an object of the present invention to provide an improved two-stage water lift marine generator muffler.

Yet another object of the present invention is to provide such a muffler that is tunable to maximize exhaust silencing and backpressure performance.

In accordance with these and other objects, which will become apparent hereinafter, the instant invention will now be described with particular reference to the accompanying drawings.

DETAILED DESCRIPTION OF THE INVENTION

The present invention may be understood more readily by reference to the following detailed description taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
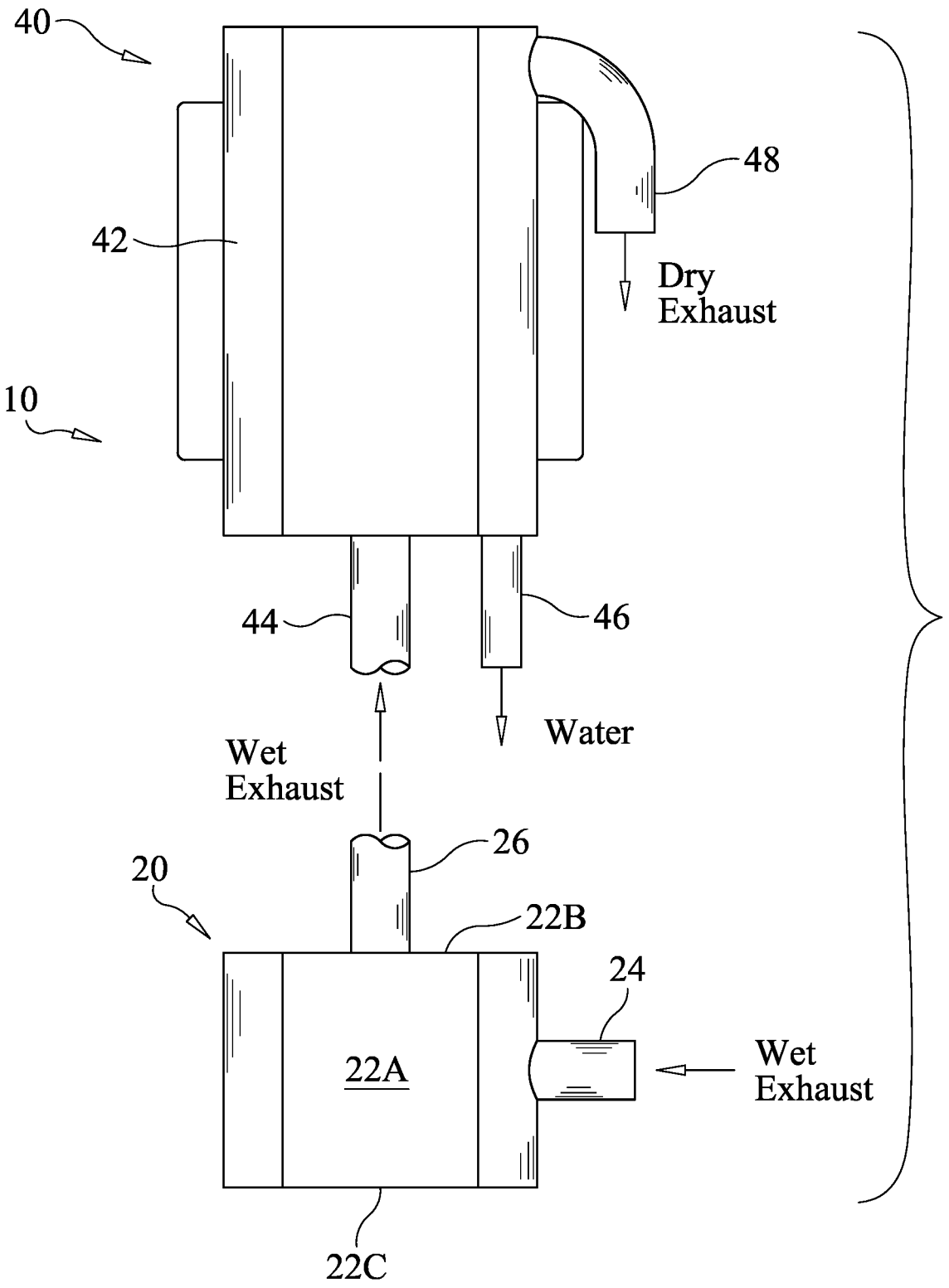
FIG. 1 is a side schematic view of a two-stage water-lift muffler having a lower first state and an upper second stage in accordance with the present invention.
Figure 2:
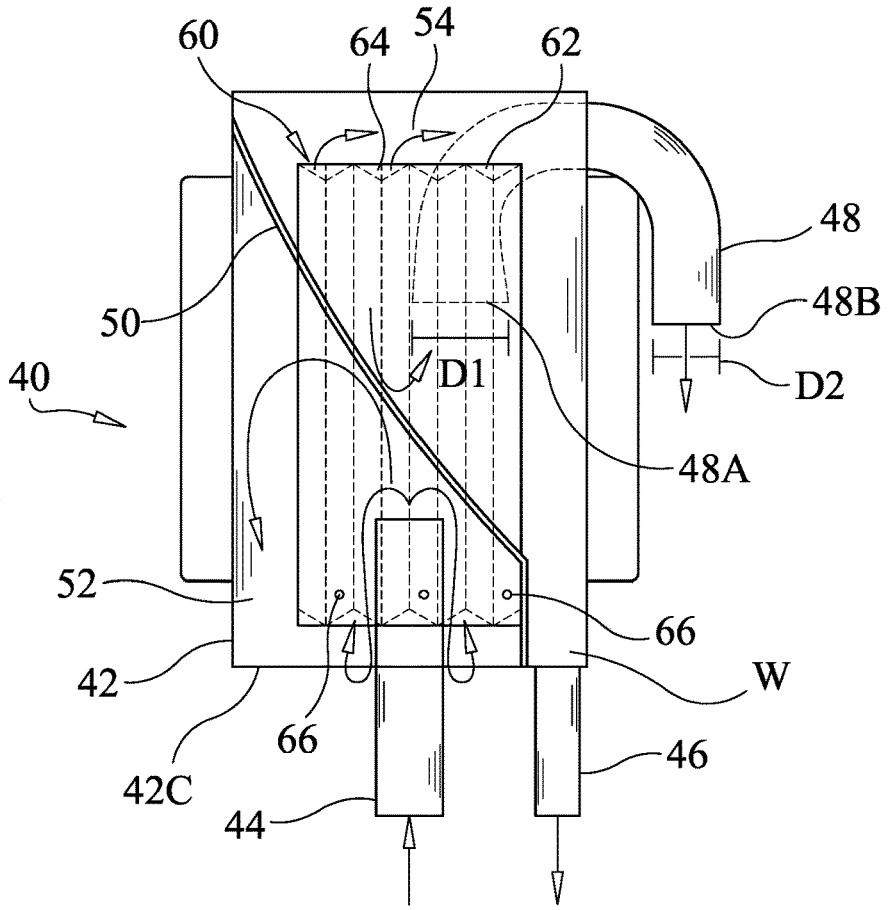
FIG. 2 is a side schematic view depicting internal structure of the upper second stage.

With reference now to the drawings, FIGS. 1 - 7 depict a two-stage water-lift muffler, generally referenced as 10, for use in marine generator applications in accordance with the present invention. Water-lift muffler 10 includes a lower first-stage component, generally referenced as 20, that functions as a water-lift muffler, and an upper second-stage component, generally referenced as 40 the functions as both a muffler and water separator. First-stage component 20 comprises a housing 22 defining an interior volume. Housing 22 is preferably fabricated from fiberglass, however, any suitable material may be used. Housing 22 includes a wet exhaust inlet pipe 24 projecting from one side thereof, and an outlet pipe 26 projecting from the top thereof. Both the inlet pipe and the outlet pipe are preferably formed by generally tubular/cylindrical structures. Wet exhaust inlet pipe 24 terminates at a beveled end 24A disposed within the housing as illustrated in FIG. 2. Outlet pipe 26 originates at a beveled end 26A disposed in proximity to the bottom of housing 22 and extends vertically upward through the interior of the housing and projects from the top thereof.

Figure 5:
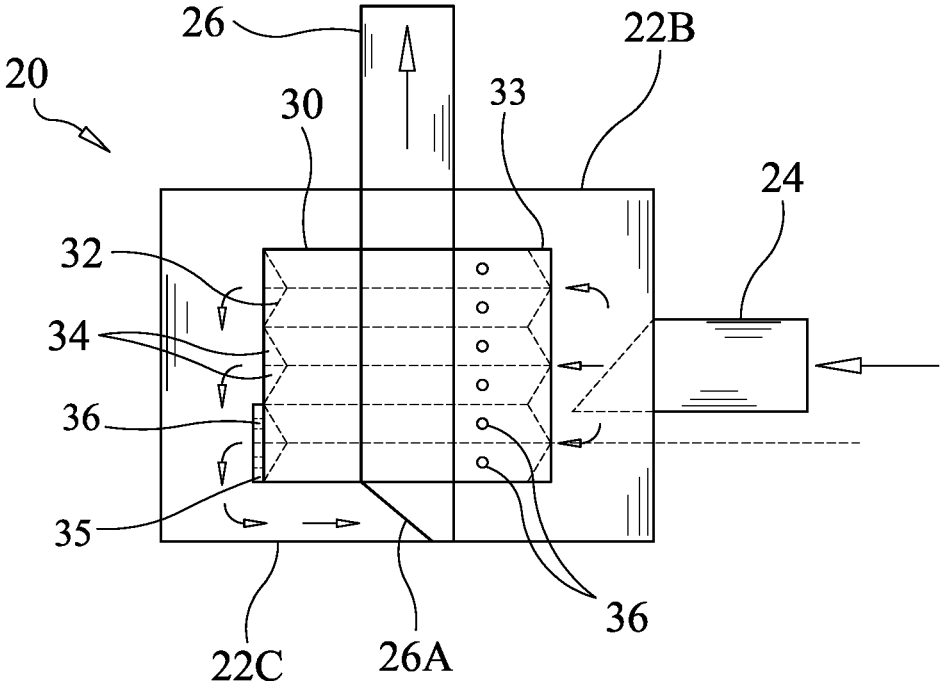
FIG. 5 is a side schematic view depicting internal structure of the lower first stage.
Figure 6:
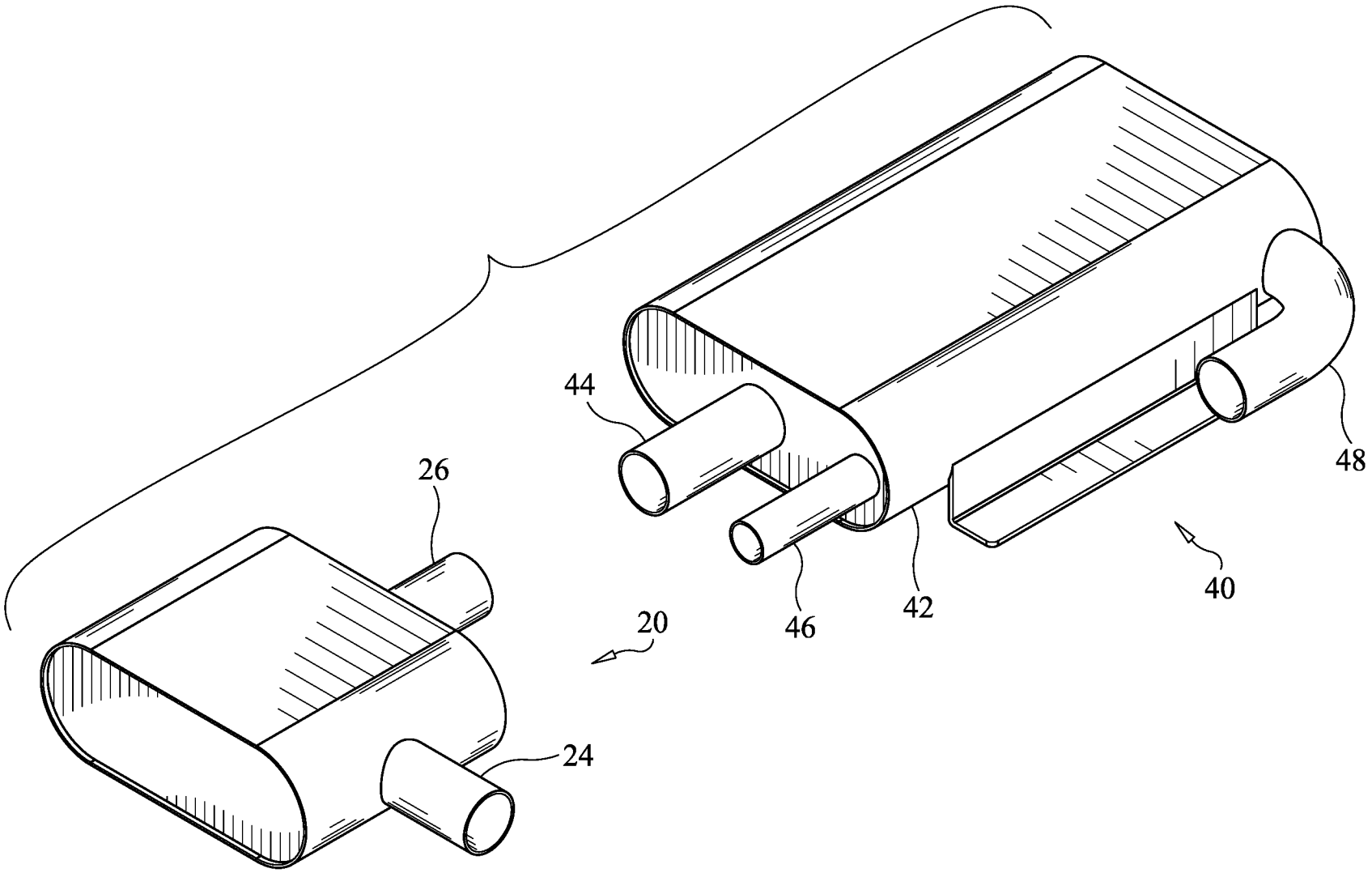
FIG. 6 is a perspective view of the two-stage water-lift muffler.
Figure 7:
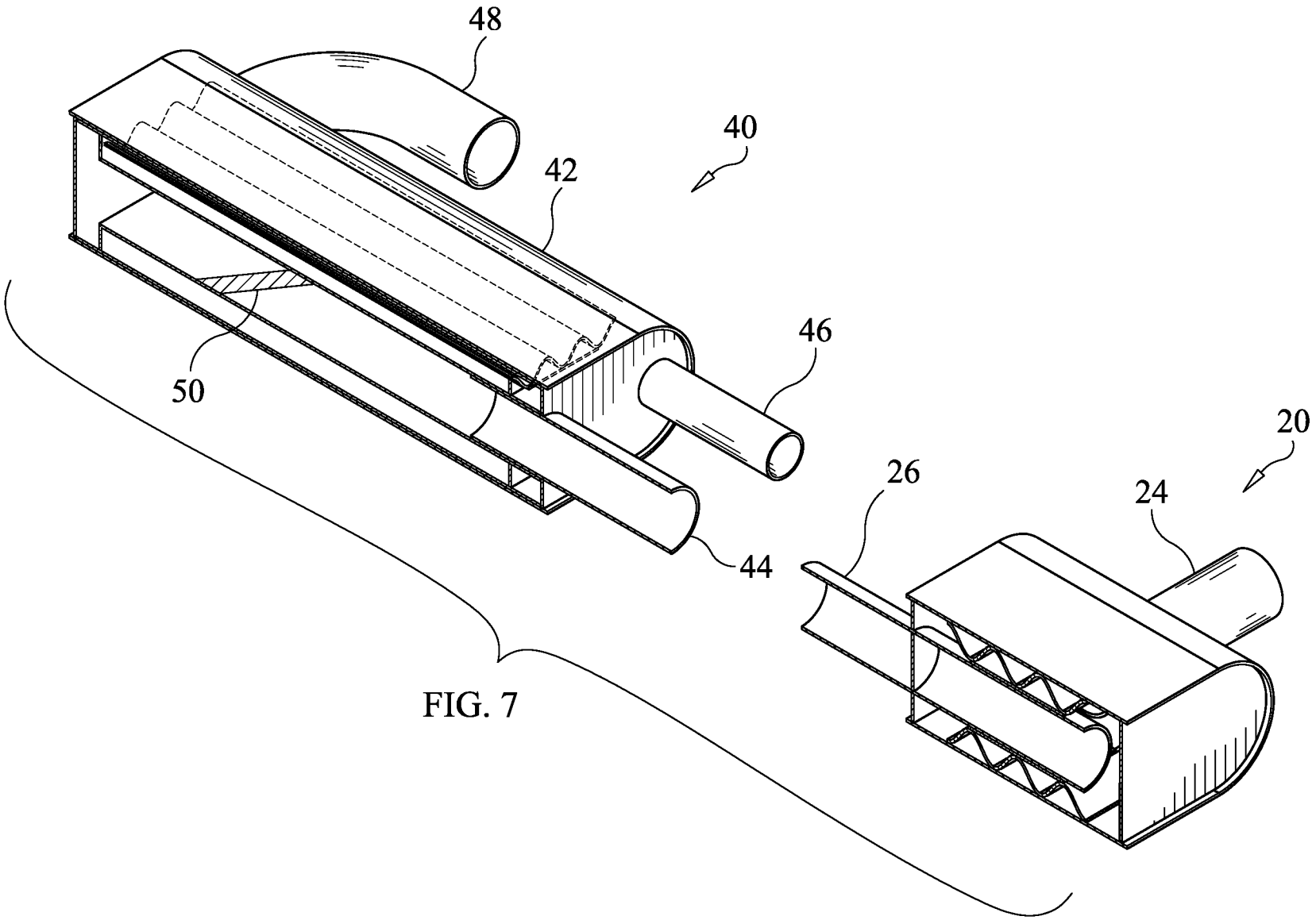
FIG. 7 is a longitudinal sectional view thereof

Housing 22 preferably defines planar opposing interior front and rear walls, each referenced as 22A, a top portion 22B, and a bottom portion 22C. Generally horizontally disposed open-ended exhaust ducts 30 are attached to each of the interior surfaces of front and rear walls 22A. Exhaust ducts 30 each extend partially between the left and right sides of housing 20 such that the opposing open ends of exhaust ducts 30 are disposed in spaced relation with the interior surfaces formed at the extreme left and right side of housing 22 as seen in FIG. 5. Each exhaust duct 30 is formed by a corrugated divider structure 32 and a planar sheet 33 whereby the exhaust duct is partitioned into a plurality of non-circular conduits or sub-ducts, referenced as 34, disposed in vertically extending and horizontally adjacent relation. A significant aspect of the present invention involves the ability to tune muffler performance by selectively closing or capping the top portions of one or more conduits with a cap 35 thereby modifying exhaust flow dynamics through the muffler resulting corresponding changes in sound suppression and backpressure. A further significant aspect of the present invention involves adapting the caps and/or the wall of exhaust duct 30 with relatively small apertures 36, which has proven effective in reducing noise and backpressure by altering exhaust gas flow dynamics. By selectively capping one or more conduits and/or varying the size and number of aperture, the muffler can be tuned for maximum performance and silencing.

Figure 4:
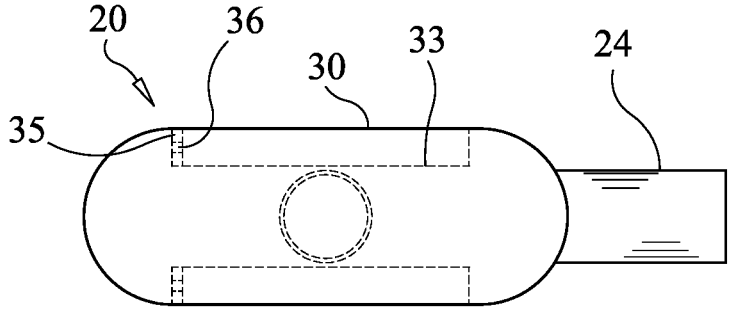
FIG. 4 is a top schematic view depicting internal structure of the lower first stage.

As shown in FIGS. 4 and 5, outlet pipe 26 pipe is sandwiched between the ducts 30 in abutting engagement with planar sheets 33 effectively dividing the housing into an inlet side and an outlet side. Accordingly, wet exhaust entering inlet pipe 24 is routed through or around the ducts 30 attached to the front and rear interior walls to the outlet side, whereafter the exhaust and entrained cooling water is allowed to exit the housing by entering the beveled end 26A of the outlet pipe urged by exhaust pressure.

Figure 3:
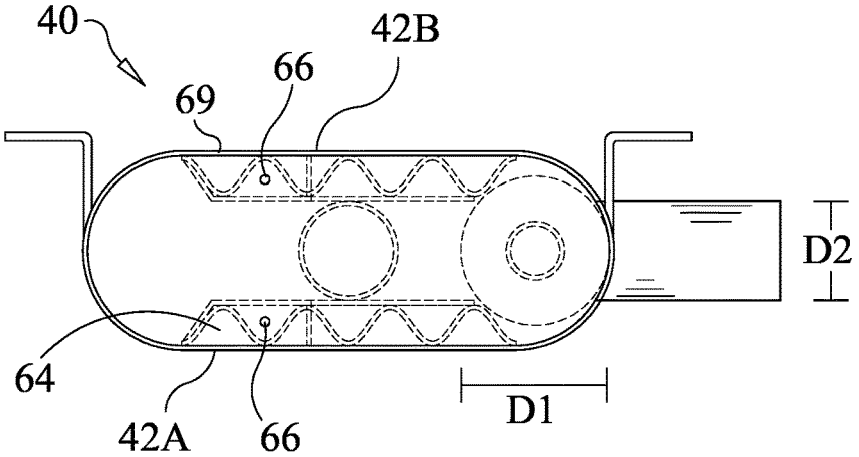
FIG. 3 is a top schematic view depicting internal structure of the upper second stage.

Turning to FIGS. 2 and 3, a second-stage of the two-stage water lift muffler comprises a water separator, generally referenced as 40 which functions to separate exhaust gas and entrained cooling water. Water separator 40 includes a housing 42 defining an internal volume and having opposing planar interior front and rear walls, each referenced as 42A, a top portion 42B, and a bottom portion 42C. A wet exhaust inlet pipe 44 enters the interior volume through the bottom of housing 42. Wet exhaust inlet pipe 44 is in fluid communication with pipe 26 of lower first-stage component 20, whereby wet exhaust flows from lower stage component 20 to water separator 40. A water outlet pipe 46 is disposed on the bottom of housing 42, and a dry exhaust outlet pipe 48 projects from an upper portion of the housing 42. Water outlet pipe 46 is disposed at the bottom of housing 42 as seen in FIG. 2 to allow for gravity assisted drainage of water from the housing. Dry exhaust outlet pipe 48 is generally shaped in the form of an inverted "U", and originates at a radially enlarged downwardly disposed opening, referenced as 48A disposed within housing 42, and terminates external to housing 42 with a downwardly disposed discharge outlet opening, referenced as 48B. The term "dry exhaust" shall be broadly construed to allow for a certain amount of water vapor present in the exhaust.

As best seen in FIG. 2, an angularly disposed baffle 50 divides the internal volume into a lower/inlet chamber 52 (e.g. the volume disposed below the baffle) and an upper/outlet chamber 54 (e.g. the volume disposed above the baffle). Accordingly, baffle 50 has a peripheral edge in sealing engagement with internal housing structure. In a preferred embodiment baffle 52 is generally planar, however, any suitable shape, such as concave or convex (about either a longitudinal axis or alternatively a transverse axis when viewed from above), is contemplated and considered within the scope of the present invention. Baffle 50 is angularly disposed or inclined as illustrated in FIG. 2. As should be apparent, the angle of inclination will vary depending on the dimensions of the muffler housing, however, in the preferred embodiment the angle of inclination is dictated by the length and height of the housing as the baffle preferably divides the housing interior into upper and lower chambers of generally equal volume. More particularly, baffle 50 extends angularly downward from in proximity to the top of housing 42 to the bottom 42C of housing 42 proximal to water outlet 46. As should be apparent, the exact terminus of baffle 50 is not considered particularly important so long as the interior of housing 42 is divided into two chambers, namely lower chamber 52 in communication with the inlet side of the baffle, and upper chamber 54 in communication with the outlet side of the baffle. While baffle 50 is preferably disposed so as to define upper and lower chambers of generally equal volumes, the baffle may be configured to form chambers of different sizes and/or dimensions in accordance with the present invention. Accordingly, exhaust entering the second stage component 40 enters the inlet chamber 52 via wet exhaust inlet pipe 44.

A generally vertically disposed, open-ended exhaust duct, generally referenced as 60, is attached to the interior surface of each of the front and rear housing walls 42A and 42B. The exhaust ducts extend partially between the top and bottom of housing 40 with upper and lower terminal ends disposed in spaced relation with corresponding upper and lower interior housing surfaces. Each exhaust duct 60 preferably defines an internal corrugated divider structure 62, and a planar sheet 63 whereby the exhaust duct is partitioned into a plurality of non-circular conduits or sub-ducts, referenced as 64, disposed in vertically extending and horizontally adjacent relation. Exhaust duct 60 penetrates baffle 50, thereby placing the lower and upper chambers 52 and 54 in fluid communication.

A significant aspect of the present invention involves the ability to tune muffler performance by selectively closing or capping the top portions of one or more conduits 64 with a cap 69, as illustrated in FIG. 3, thereby modifying exhaust flow dynamics through the muffler resulting corresponding changes in sound suppression and backpressure. A further significant aspect of the present invention involves adapting the caps and/or the wall of exhaust duct 60 with relatively small apertures 66, which has proven effective in reducing noise and backpressure by altering exhaust gas flow dynamics. By selectively capping one or more conduits and/or varying the size and number of apertures, the muffler can be tuned for maximum performance and silencing.

Wet exhaust exiting first stage component 20 via outlet 26 enters housing 42, via wet exhaust inlet 44, whereby the wet exhaust enters lower chamber 52. The wet exhaust passes through duct 60 by entering the lowermost portion whereafter the wet exhaust passes upward through conduits 64 exiting at the uppermost portion of duct 60 into upper chamber 54. Entrained cooling water within upper chamber 54 flows downward and collects at the bottom of chamber 54, where the collected cooling water is allowed to exit housing 42 via water outlet 46. Exhaust gas within upper chamber 54 flows into outlet pipe 48 by entering opening 48A, and exits outlet pipe via discharge opening 48B. Outlet pipe 48 is formed with opening 48A having a diameter, referenced as D1, and discharge opening 48B is formed with a diameter, referenced as D2. A significant aspect of the present invention involves providing opening 48A with a larger diameter (or cross-sectional area) D1, than discharge opening 48B. The increased diameter/cross-sectional area minimizes the exhaust gas velocity entering outlet pipe 48 thereby preventing cooling water in upper chamber 54 from being entrained and carried into outlet pipe by the flowing exhaust gas. As should be apparent, additional exhaust pipe (not shown) connected to discharge 48B is used to rout the exhaust gas from the vessel, and additional water pipe (not shown) is connected to water outlet 46 to rout water from the vessel.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A two-stage water lift muffler comprising:

a first housing and a second housing, said first and second housings disposed in vertically spaced relation, with said second housing disposed above said first housing;

said first housing defining a first internal volume and including a wet exhaust inlet pipe and a wet exhaust outlet pipe, said wet exhaust outlet pipe originating within said interior volume and extending through said internal volume and from said first housing;

said second housing defining a second internal volume with an internal baffle dividing said second internal volume into an inlet chamber disposed below said baffle, and an outlet chamber disposed above said baffle;

said inlet chamber in fluid communication with said wet exhaust outlet pipe of said first housing;

at least one open-ended exhaust duct penetrating said baffle thereby placing said inlet chamber in fluid communication with said outlet chamber;

a water outlet disposed at the bottom of said second housing and in fluid communication with said outlet chamber; and an exhaust outlet in fluid communication with said outlet chamber.

2. The two-stage water-lift muffler according to claim 1, wherein said at least one exhaust duct is partitioned into a plurality of exhaust conduits.

3. The two-stage water-lift muffler according to claim 2, wherein said plurality of exhaust conduits include non-circular conduits.

4. A two-stage water lift muffler comprising:

a first housing defining a first interior volume;

a wet exhaust inlet providing fluid communication between said first interior volume and a source of wet exhaust;

a vertically disposed wet exhaust outlet pipe partitioning said first interior volume into an inlet side and an outlet side;

a first duct providing fluid communication between the inlet side and the outlet side of said first interior volume;

and a second housing defining a second interior volume;

an internal baffle dividing said second internal volume into an inlet chamber disposed below said baffle, and an outlet chamber disposed above said baffle;

said inlet chamber in fluid communication with said wet exhaust outlet pipe;

a second duct penetrating said baffle thereby placing said inlet chamber in fluid communication with said outlet chamber;

a water outlet disposed at the bottom of said second housing and in fluid communication with said outlet chamber; and an exhaust outlet in fluid communication with said outlet chamber.

5. The two-stage water-lift muffler according to claim 4, wherein said first duct is partitioned into a plurality of first exhaust conduits.

6. The two-stage water-lift muffler according to claim 5, wherein said plurality of first exhaust conduits include conduits defining non-circular cross-sections.

7. The two-stage water-lift muffler according to claim 4, wherein said second duct is partitioned into a plurality of second exhaust conduits.

8. The two-stage water-lift muffler according to claim 7, wherein said plurality of second exhaust conduits include conduits defining non-circular cross-sections.

* * * * *